US006206808B1

(12) United States Patent
Ho

(10) Patent No.: US 6,206,808 B1
(45) Date of Patent: Mar. 27, 2001

(54) ANGLE-ADJUSTABLE ROWING EXERCISER

(76) Inventor: Sung-Chao Ho, P.O. Box 24-108, Taipei (TW)

( * ) Notice: Subject to any disclaimer, the term of this patent is extended or adjusted under 35 U.S.C. 154(b) by 0 days.

(21) Appl. No.: 09/396,510

(22) Filed: Sep. 15, 1999

(51) Int. Cl.[7] ..... A63B 21/068

(52) U.S. Cl. ..... 482/95; 482/71; 482/72; 482/96

(58) Field of Search ..... 482/71, 72, 95, 482/135, 140, 142, 908, 96

(56) References Cited

U.S. PATENT DOCUMENTS 4,489,936 * 12/1984 Dal Monte ..... 272/120

4,684,126 * 8/1987 Dalebout et al. ..... 272/134

* cited by examiner

*Primary Examiner*—Jerome W. Donnelly
*Assistant Examiner*—Lori Baker Amerson

(57) ABSTRACT

An angle-adjustable rowing exerciser, which includes a wheeled base frame, a fixed mattress and a pivoted mattress supported on the base frame, a transverse frame bar pivotally mounted on the base frame at the bottom, two handlebars respectively adjustably connected to two adjustable ratchet connectors at the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars.

3 Claims, 6 Drawing Sheets

ANGLE-ADJUSTABLE ROWING EXERCISER

BACKGROUND OF THE INVENTION

The present invention relates to a rowing exerciser, and more particularly to an angle-adjustable rowing exerciser, which can be conveniently adjusted to the desired angle of inclination.

A variety of exercising apparatus have been disclosed for different exercising purposes, and have appeared on the market. Regular multipurpose exercising apparatus are commonly heavy and expensive, and not suitable for home use. Regular simple climbers, rowers, stationary bicycles are less expensive, and suitable for home use. However, these exercising apparatus are designed for one particular exercising purpose only.

SUMMARY OF THE INVENTION

The present invention has been accomplished under the circumstances in view. It is one object of the present invention to provide an angle-adjustable rowing exerciser, which is practical for exercising different parts of the body. It is another object of the present invention to provide an angle-adjustable rowing exerciser, which is inexpensive to manufacture, and suitable for home use. It is still another object of the present invention to provide an angle-adjustable rowing exercising, which can be conveniently adjusted to fit different exercising requirements. According to one aspect of the present invention, the angle-adjustable rowing exerciser comprises a wheeled base frame, a fixed mattress and a pivoted mattress supported on the base frame, a transverse frame bar pivotally mounted on the base frame at the bottom, two handlebars respectively connected to the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars. According to another aspect of the present invention, the transverse frame bar comprises two adjustable ratchet connectors at its two distal ends respectively connected to the handlebars, enabling the handlebars to be adjusted to one of a series of angular positions relative to the transverse frame bar.

DETAILED DESCRIPTION OF THE PREFERRED EMBODIMENT

Figure 2:
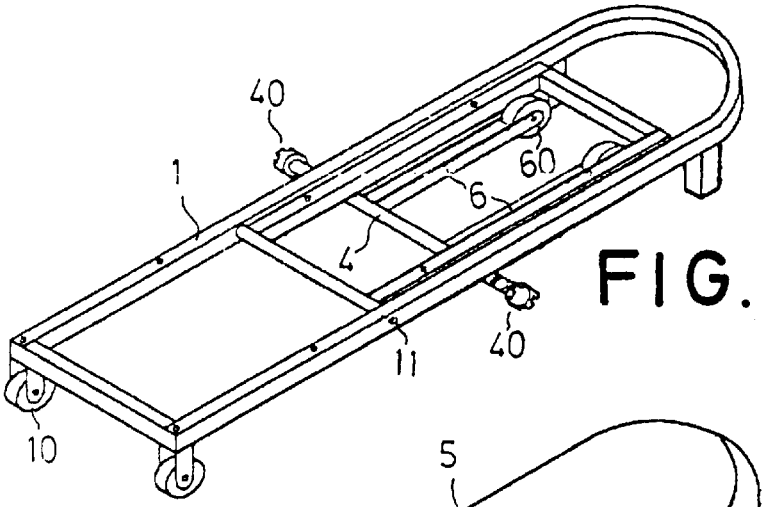
FIG. 2 is a perspective view of the present invention after removal of the first mattress, the second mattress, and the handlebars.
Figure 1:
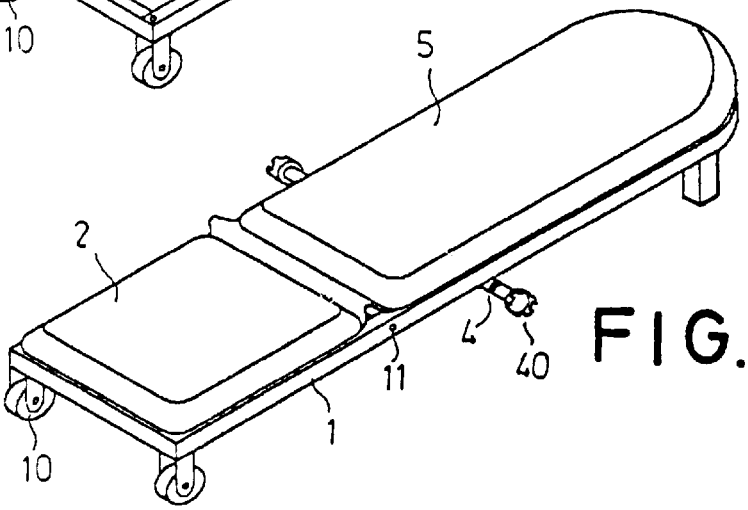
FIG. 1 is a perspective view of an angle-adjustable rowing exerciser according to the present invention (the handlebars excluded)

Referring to Figures from 1 through 4, an angle-adjustable rowing machine is sown comprised of an elongated base frame 1, a first mattress 2, a pair of handlebars 3, a transverse frame bar 4, a second mattress 5, and a pair of actuating bars 6.

The base frame 1 is equipped with rollers 10 for easy moving on the floor. The first mattress 2 is fixedly mounted on the base frame 1 at one end. The second mattress 5 has one end pivoted to a middle part of the base frame 1 by a pivot 11. When lied down, the second mattress 5 is supported on the base frame 1 and aligned with the first mattress 2 in a line. The transverse frame bar 4 is pivotally mounted on the base frame 1 below the second mattress 5, having two ratchet connectors 40 at two distal ends thereof. The handlebars 3 are respectively connected to the ratchet connectors 40, and adjusted to the desired angle relative to the transverse frame bar 4. The actuating bars 6 are perpendicularly and fixedly connected to the transverse frame bar 4, each having a distal end mounted with a roller 60. The base frame 1 may set holes 12 at the side of the second mattress 5 (see FIGS. 11 and 12). The holes 12 can insert a bar to confine the inclined angle of the actuating bars 6.

Figure 4:
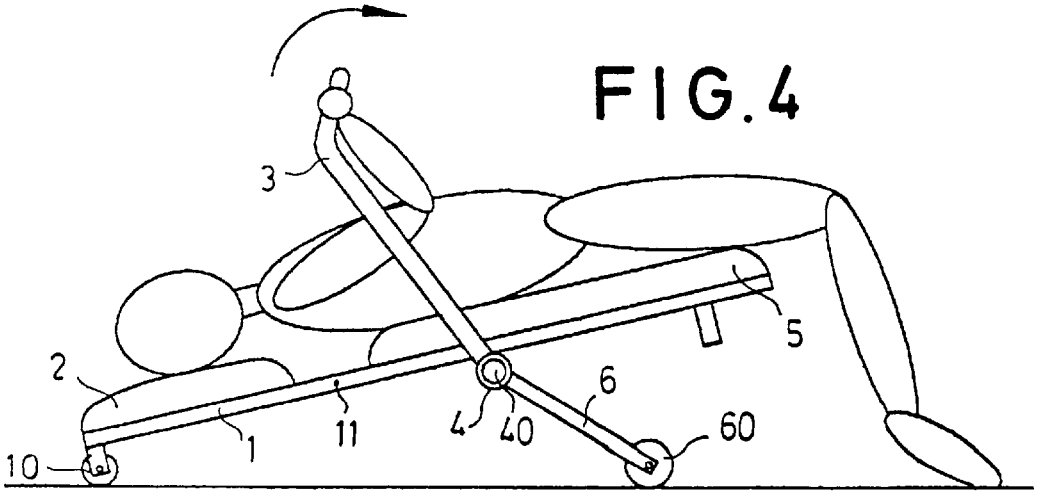
FIG. 4 shows a first application example of the present invention.
Figure 3:
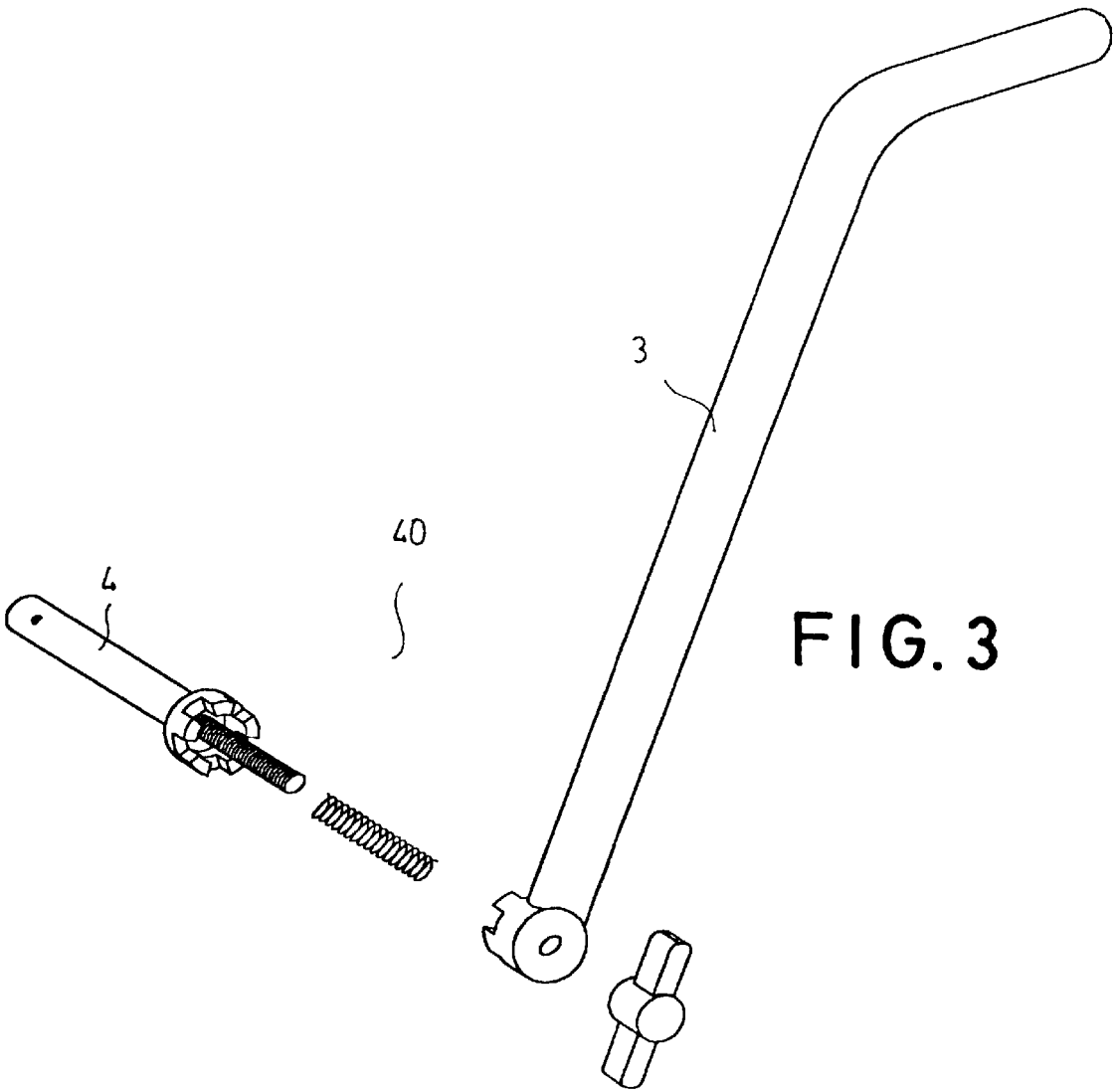
FIG. 3 is an exploded view of a part of the present invention, showing the structure of a ratchet connector.
Figure 5:
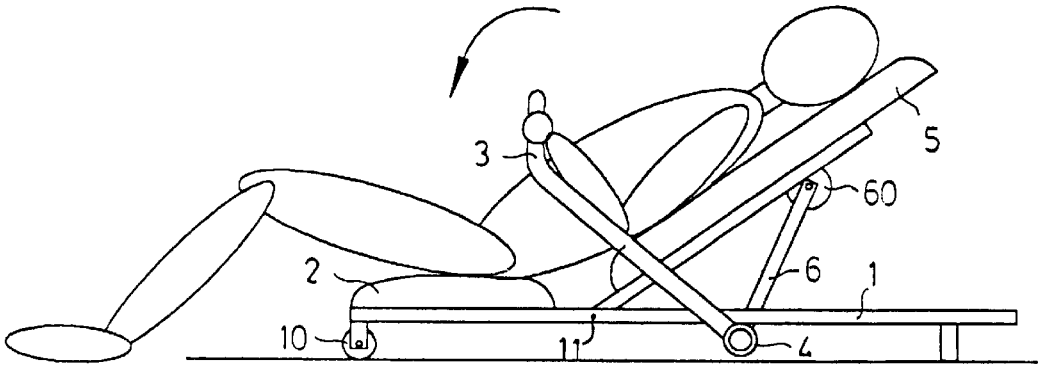
FIG. 5 shows a second application example of the present invention.
Figure 6:
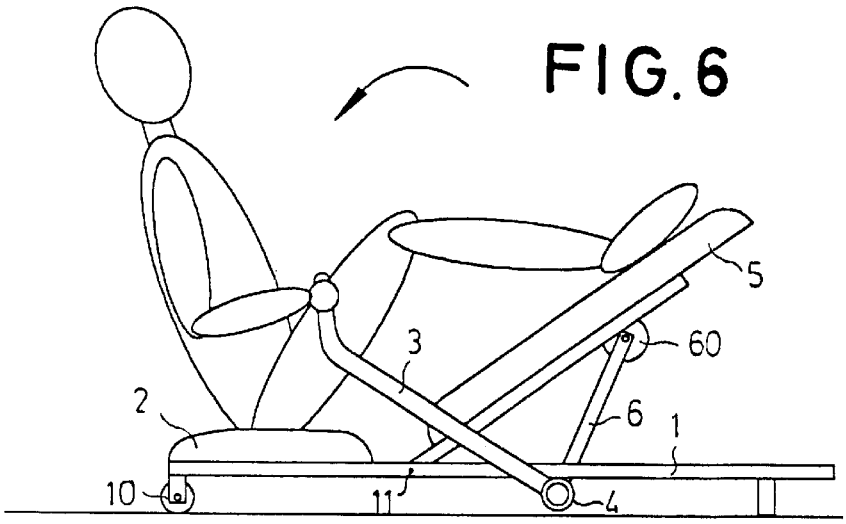
FIG. 6 shows a third application example of the present invention.
Figure 7:
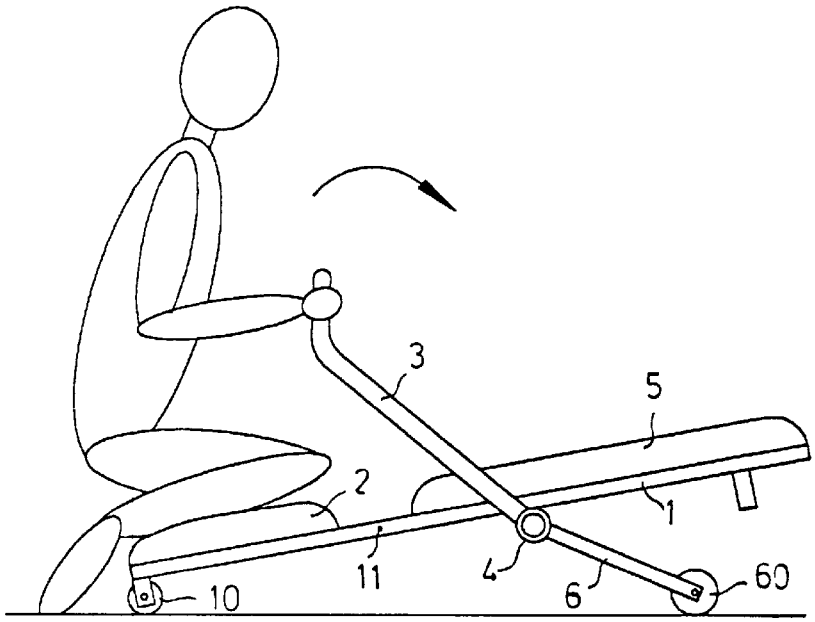
FIG. 7 shows a fourth application example of the present invention.
Figure 8:
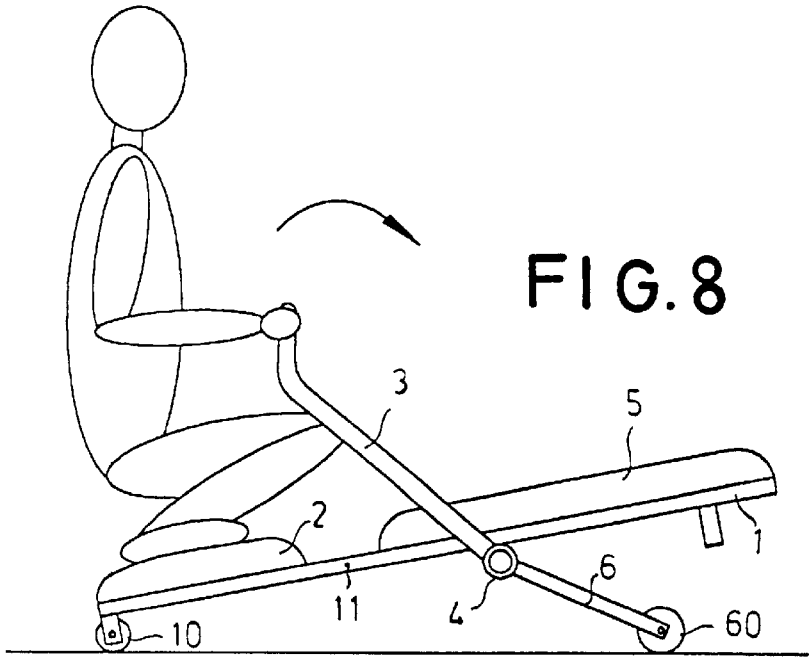
FIG. 8 shows a fifth application example of the present invention.
Figure 9:
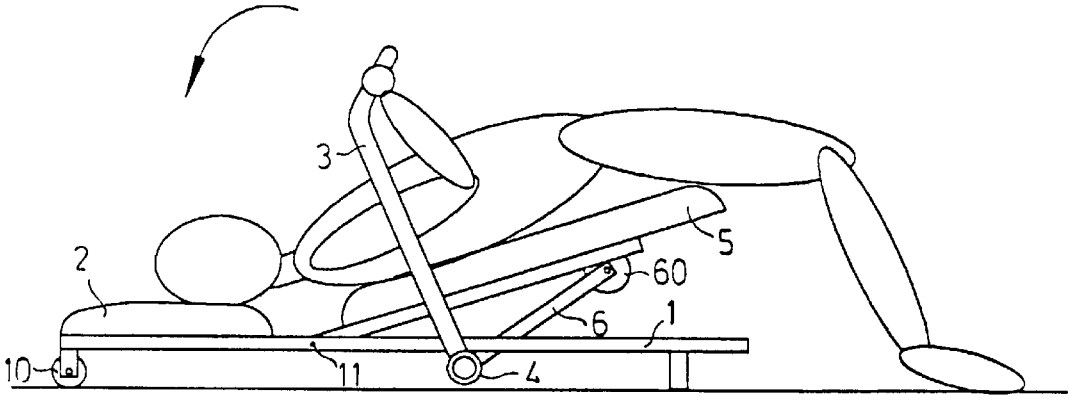
FIG. 9 shows a sixth application example of the present invention.
Figure 10:
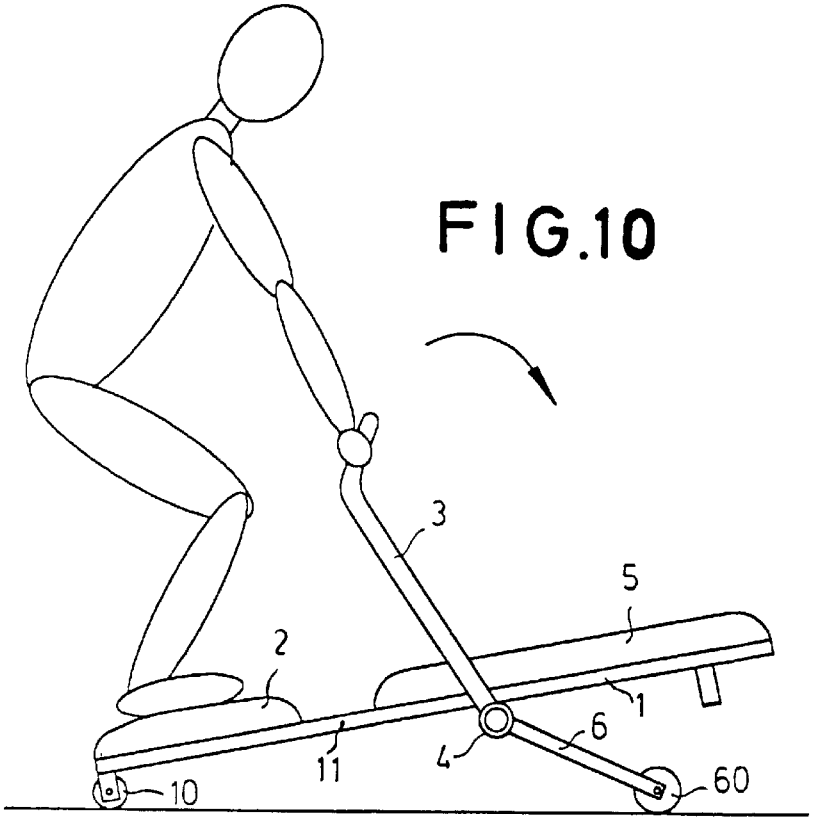
FIG. 10 shows a seventh application example of the present invention.
Figure 11:
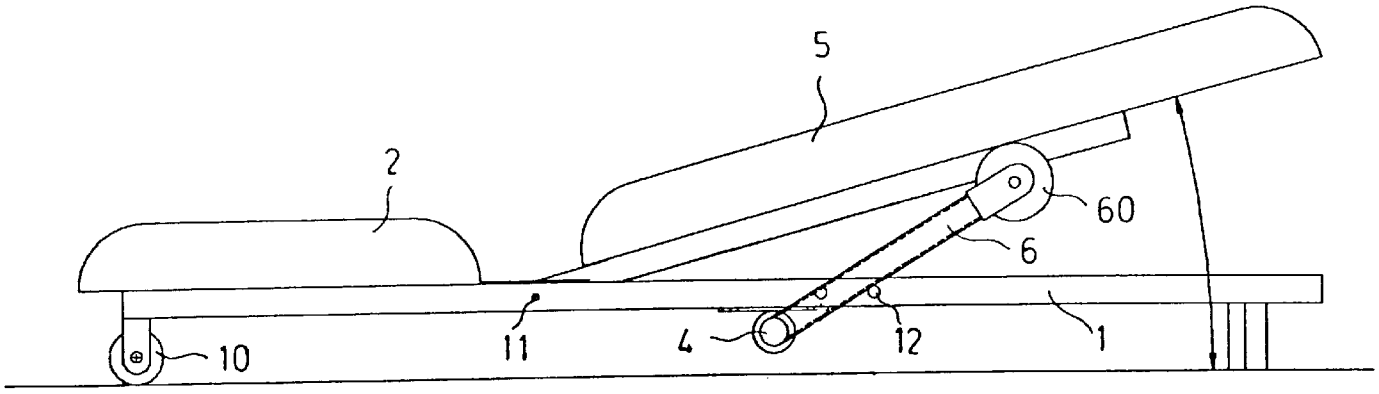
FIG. 11 is a schematic side view of an another base frame of the present invention in one way.
Figure 12:
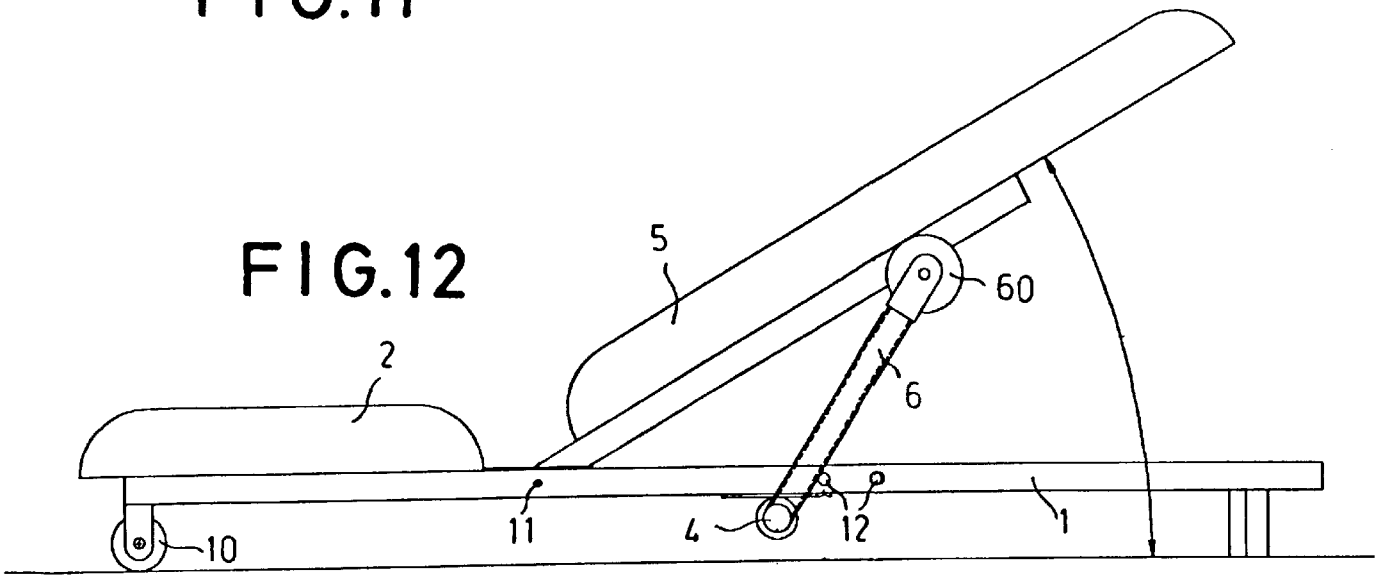
FIG. 12 is a schematic side view of the present invention in FIG. 11 in another way.

Referring to Figures from 5 through 10 and FIG. 4 again, the angle-adjustable rowing exerciser can be operated in any of a variety of operation modes. For example, the user can lie on the mattresses 2 and 5, sit, kneel or stand on the first mattress 2, or sit on the heels above the first mattress 2, and turn the handlebars 3 back and forth when keeping the rollers 60 of the actuating bars 6 stopped at the floor (see FIGS. 4, 7, 8 and 10) or the bottom of the second mattress 5 (see FIGS. 5, 6 and 9). When turning the handlebars 3 back and forth, the second mattress 5 or the base frame 1 is tilted up and down. By means of adjusting the angular position of the handlebars 3 relative to the transverse frame bar 4, the exercising amount is relatively adjusted. Referring to FIGS. 11 and 12, when insert a bar into the holes 12. Because the actuating bars 6 is confined by the bar. So the second mattress 5 only can incline an angle.

It is to be understood that the drawings are designed for purposes of illustration only, and are not intended for use as a definition of the limits and scope of the invention disclosed.

What the invention claimed is:

1. An angle-adjustable rowing exerciser comprising:

a base frame equipped with rollers for moving on the floor;

a first mattress fixedly mounted on said base frame at one end;

a second mattress for supporting the user on said base frame, said second mattress having one end pivoted to a middle part of said base frame adjacent to said first mattress by a pivot;

a transverse frame bar transversely pivoted to said base frame below said second mattress, said transverse frame bar having two distal ends extended out of two opposite lateral sides of said base frame;

two handlebars respectively connected to the two distal ends of said transverse frame bar for turning by hand to rotate said transverse frame bar; and two actuating bars perpendicularly and fixedly connected to said transverse frame bar, said actuating bars each having a distal end mounted with a roller.

2. The angle-adjustable rowing exerciser of claim 1 wherein said transverse frame bar comprises two adjustable ratchet connectors respectively disposed at the two distal ends thereof and connected to said handlebars to hold said handlebars in one of a series of angular positions relative to said transverse frame bar.

3. The angle-adjustable rowing exerciser of claim 1 wherein said base frame set holes at the side of said second mattress. The holes can insert a bar to confine the inclined angle of said actuating bars.

* * * * *